US006029456A

United States Patent [19]

Zaiser

[11] Patent Number: 6,029,456

[45] Date of Patent: Feb. 29, 2000

[54] CONVOLUTED NECK TUBE FOR CRYOGENIC STORAGE VESSELS

[76] Inventor: LeNoir E. Zaiser, 550 Admiralty Parade West, Naples, Fla. 34102

[21] Appl. No.: 08/853,632

[22] Filed: May 9, 1997

Related U.S. Application Data

[60] Provisional application No. 60/017,465, May 10, 1996.

[51] Int. Cl.[7] ..... F17C 1/00

[52] U.S. Cl. ..... 62/45.1; 62/51.1

[58] Field of Search ..... 62/45.1, 51.1

[56] References Cited

U.S. PATENT DOCUMENTS

| | | | |
|---|---|---|---|
| 2,785,536 | 3/1957 | Hinkley | 62/51.1 X |
| 3,066,222 | 11/1962 | Poorman et al. | 62/51.1 X |
| 3,097,084 | 7/1963 | Putman | 62/45.1 |
| 3,119,238 | 1/1964 | Chamberlain et al. | 62/51.1 |
| 3,190,081 | 6/1965 | Pytryga | 62/51.1 X |
| 3,306,058 | 2/1967 | Keilin | 62/51.1 |
| 3,611,746 | 10/1971 | Marsing et al. | 62/51.1 |
| 3,688,514 | 9/1972 | Prost | 62/51.1 |
| 4,218,892 | 8/1980 | Stephens | 62/51.1 |

*Primary Examiner*—Ronald Capossela

*Attorney, Agent, or Firm*—Hamilton, Brook, Smith & Reynolds, P.C.

[57] ABSTRACT

A convoluted or multiple-pass neck tube joins inner and outer elements of a vacuum-jacketed vessel. The additional length of the convoluted neck tube creates an increased distance for heat to conduct from the outer to the inner vessel. As such, a convoluted neck tube can be substitute in place of a straight neck tube or a bellows neck tube to reduce heat gain into the inner vessel. An additional benefit achieved by the convoluted neck tube is greater flexibility of the neck tube, thus yielding more stress resistance.

30 Claims, 5 Drawing Sheets

CONVOLUTED NECK TUBE FOR CRYOGENIC STORAGE VESSELS

RELATED APPLICATIONS

This application claims priority to U.S. Provisional Application No. 60/017,465 filed May 10, 1996, the contents of which are incorporated herein by reference in their entirety.

BACKGROUND OF THE INVENTION

Vacuum-jacketed cryogenic storage vessels are used to store liquified gasses at extremely low temperatures. To maintain the gas in a liquid state, heat transfer from the ambient environment to the liquified gas must be restricted. To accomplish this, the cryogenic vessels comprise an inner vessel within an outer vessel, the walls of the vessels being separated by an insulating vacuum and radiation barrier. A neck tube connects the inner vessel to the outer vessel to permit filling and extraction of liquified gas from storage in the inner vessel. Most prior art cryogenic vessels include a straight, thin wall tube between the inner and outer vessels.

The conduction of heat to the inner vessel affects the natural evaporation rate (NER) of the cryogenic vessel. The more heat that is conducted from the outside to the inner vessel, the faster the rate of boil-off of the cryogenic liquid or the greater the NER. Unfortunately, the neck tube provides a thermal conductive path from the ambient environment to the inner vessel.

The amount of heat transfer through the neck tube depends on a number of factors. First, heat transfer is dependent on the thermal conductivity of the neck tube material. In addition, heat transfer is proportional to the mass of the neck tube cross-section and inversely proportional to the length of the neck tube. Some prior art cryogenic vessels have incorporated bellows neck tube assemblies to increase the length of the tubing, and thus the thermal transfer path, but not the distance between the inner and outer vessel.

SUMMARY OF THE INVENTION

Typical bellows assemblies offer an additional advantage in that they can flex freely in case of a vibration or shock to the vessel. There are, however, disadvantages to bellows assemblies. One disadvantage is that they must incorporate exterior supports to prevent the tube from deforming and to provide axial and radial support of the inner vessel. In addition, bellows assemblies are relatively expensive to manufacture.

In general, a preferred environment of the invention is a conduit having an input port and an output port for respectively receiving and delivering a substance. A conduit body of a rigid material connects the input port to the output port and rigidly maintains a longitudinal distance between the input port and the output port. In addition, the conduit body can flexibly maintain a lateral displacement transverse to the longitudinal axis between the input port and the output port. Preferably, there is no nominal displacement between the ports in the lateral direction. The input and output ports can however have a different opening area. In a particular embodiment of the invention, the conduit body has a single wall with a length that is greater than the longitude distance between the input and output ports. Furthermore, the conduit body preferably comprises a plurality of concentric tubes joined together to create convolutions in the single wall.

The invention is preferably embodied in a thermal insulated vessel. The vessel includes an inner vessel for storing the material at a first temperature and an outer vessel insulating the inner vessel from an ambient environment at a second temperature. In particular, the first temperature is a cryogenic temperature and the second temperature is a significantly higher temperature such as room temperature. In a vacuum-jacketed vessel, the inner and outer vessel are separated by a vacuum chamber and a radiant barrier.

A convoluted conduit preferably couples the inner vessel to the outer vessel. The convoluted conduit preferably comprises a plurality of concentric tube sections to create a conductive path which is longer than the longitudinal length of the conduit. The convoluted conduit can be fabricated from a unitary piece of material or can feature a plurality of welded folds. The convoluted conduit is flexible along the transverse axis of the conduit and is rigid along the longitudinal axis of the conduit.

In accordance with preferred embodiments of the invention, the convoluted or multi-pass neck tube effectively increases the length of the thermal transfer path between the outer and inner vessels. Because the length of the convoluted neck tube is rigid, no further external supports are needed. Furthermore, multiple concentric tubes act as leaf springs to provide flexibility without permanent deformation or fatigue of the neck tube. In addition to the technical benefits, convoluted neck tubes in accordance with preferred embodiments of the invention can be manufactured at a fraction of the cost of bellows assemblies.

BRIEF DESCRIPTION OF THE DRAWINGS

The above and other features of the invention, including various novel details of construction and combination of parts, will now be more particularly described with reference to the accompanying drawings and pointed out in the claims. It will be understood that the particular convoluted neck tubes for cryogenic storage vessels embodying the invention are shown by illustration only and not as a limitation of the invention. The principles and features of the invention may be embodied in varied and numerous embodiments without departing from the scope of the invention.

DETAILED DESCRIPTION OF PREFERRED EMBODIMENTS OF THE INVENTION

Figure 1:
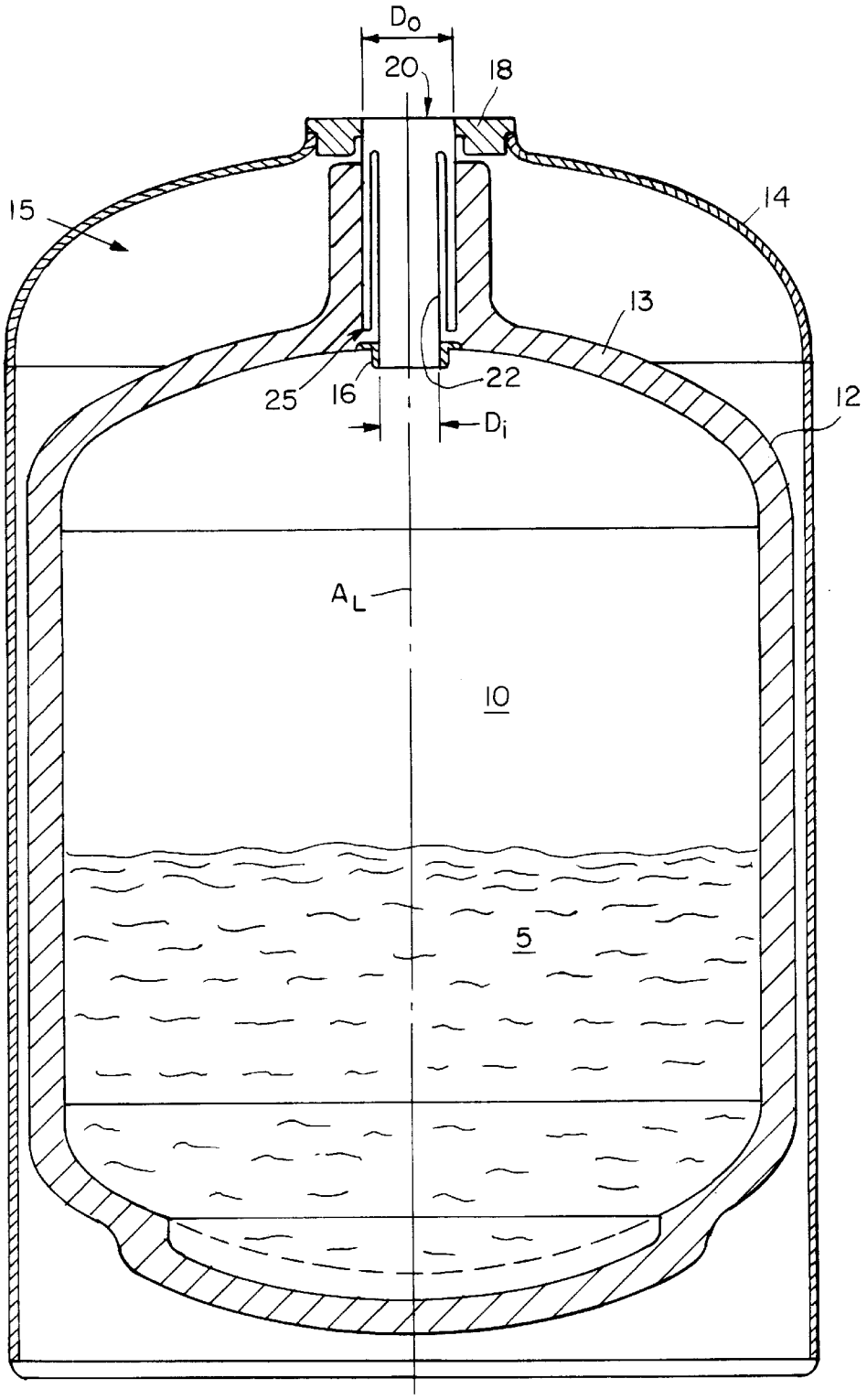
FIG. 1 is a cross-sectional diagram taken along a longitudinal axis of a preferred cryogenic storage vessel embodying the invention.

FIG. 1 is a cross-sectional diagram taken along a longitudinal axis $A_L$ of a preferred cryogenic storage vessel embodying the invention. As illustrated, a cryogenic liquified gas 5, such as oxygen or nitrogen, is contained within a storage cavity 10 of an inner vessel 12. The inner vessel 12 is wrapped by a radiant barrier 13, which is contained within an outer vessel 14, separated by an insulative vacuum cavity 15 to yield a vacuum-jacketed vessel. The storage cavity 10 is connected to the outside of the outer vessel 14 by a neck tube 20. The neck tube 20 is welded either directly to the inner vessel 12 or, as illustrated, to an inner plate 16 which is itself welded to the walls of the inner vessel 12. Similarly, the neck tube 20 is welded to an outer plate 18 which is welded to the walls of the outer vessel 14.

In accordance with a preferred embodiment of the invention, the neck tube 20 includes a convoluted conductive path. That is, the conductive wall 22 of the neck tube 20 follows a convoluted path from the outer vessel 14 to the inner vessel 12. These convolutions are embodied in at least one annular fold 25 in the neck tube 20. In a particular embodiment, the neck tube 20 has a different external (i.e., facing the external environment) port diameter $D_e$ than internal (i.e., facing the internal storage cavity) port diameter $D_i$. As particularly illustrated, the external port diameter $D_e$ is greater than the internal port diameter $D_i$.

Figure 2:
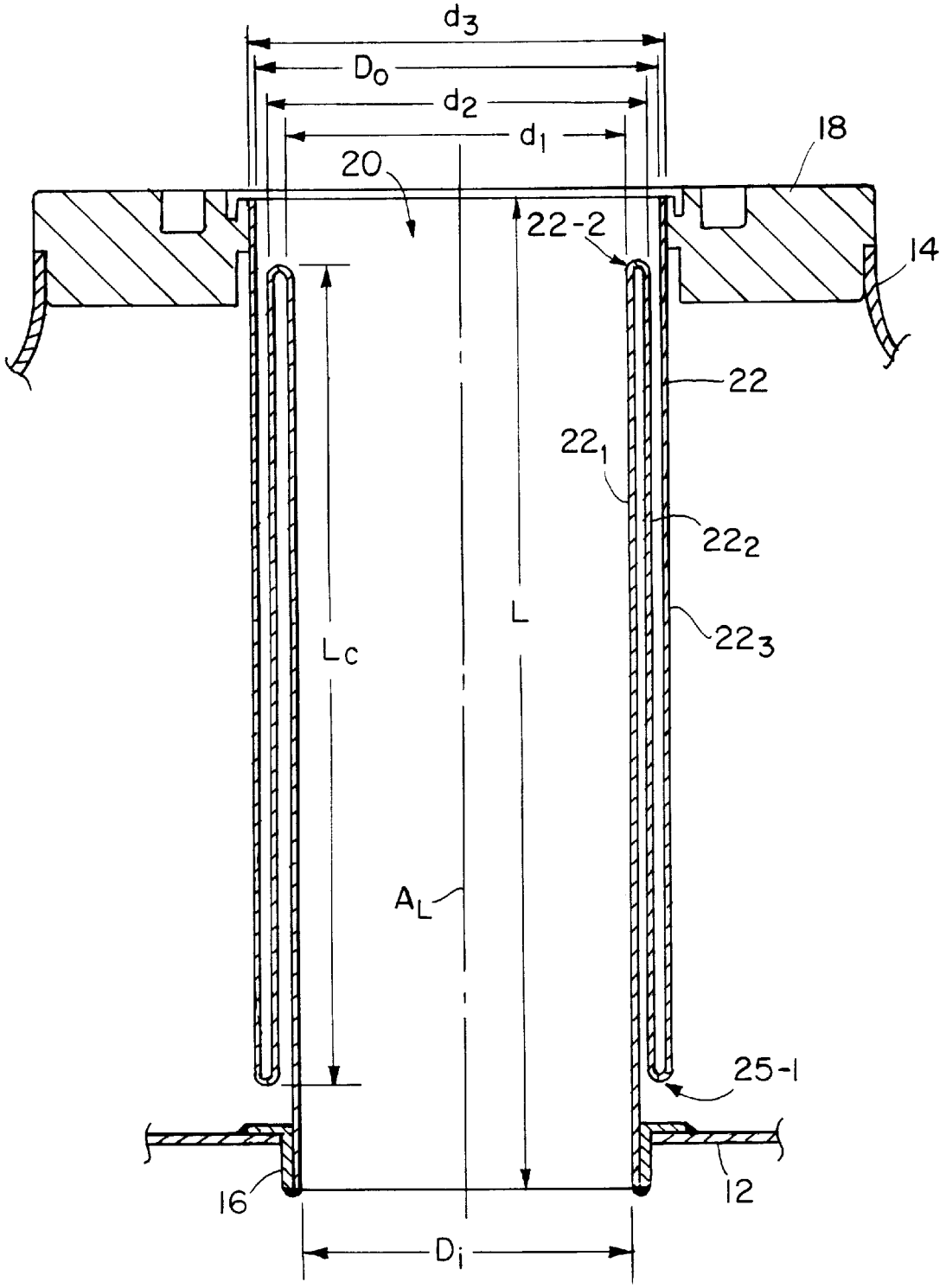
FIG. 2 is a cross-sectional diagram of a preferred neck tube taken along the longitudinal axis.

FIG. 2 is a cross-sectional diagram of a preferred neck tube taken along the longitudinal axis $A_L$. As illustrated, the neck tube 20 includes a first fold 25-1 and a second fold 25-2 along its longitudinal axis $A_L$. The neck tube 20 can thus be viewed as a plurality of concentric tubes $\mathbf{22}_1$, $\mathbf{22}_2$, $\mathbf{22}_3$ joined together at the folds 25-1, 25-2. Although the physical length of the neck tube 20 is L, the convolute length $L_c$ can effectively triple the length of the tubing 22 in the neck tube 20, when $L_c$ approaches L. As such, thermal conduction through the tube wall 22 can be greatly decreased.

As illustrated, the neck tube 20 includes three concentric tubes $\mathbf{22}_1$, $\mathbf{22}_2$, $\mathbf{22}_3$, each having a respective outer diameter $d_1$, $d_2$, $d_3$. In a particular embodiment, a first tube $\mathbf{22}_1$, has an outer diameter of 0.50 inch, a second tube $\mathbf{22}_2$ has an outer diameter of 0.75 inch, and a third tube $\mathbf{22}_3$ has an outer diameter of 1.00 inch. Each tube $\mathbf{22}_1$, $\mathbf{22}_2$, $\mathbf{22}_3$ can have an equal transverse thickness, such as 0.020 inch. The neck tube 20 has a preferred length L of 5.5 inches.

Figure 3:
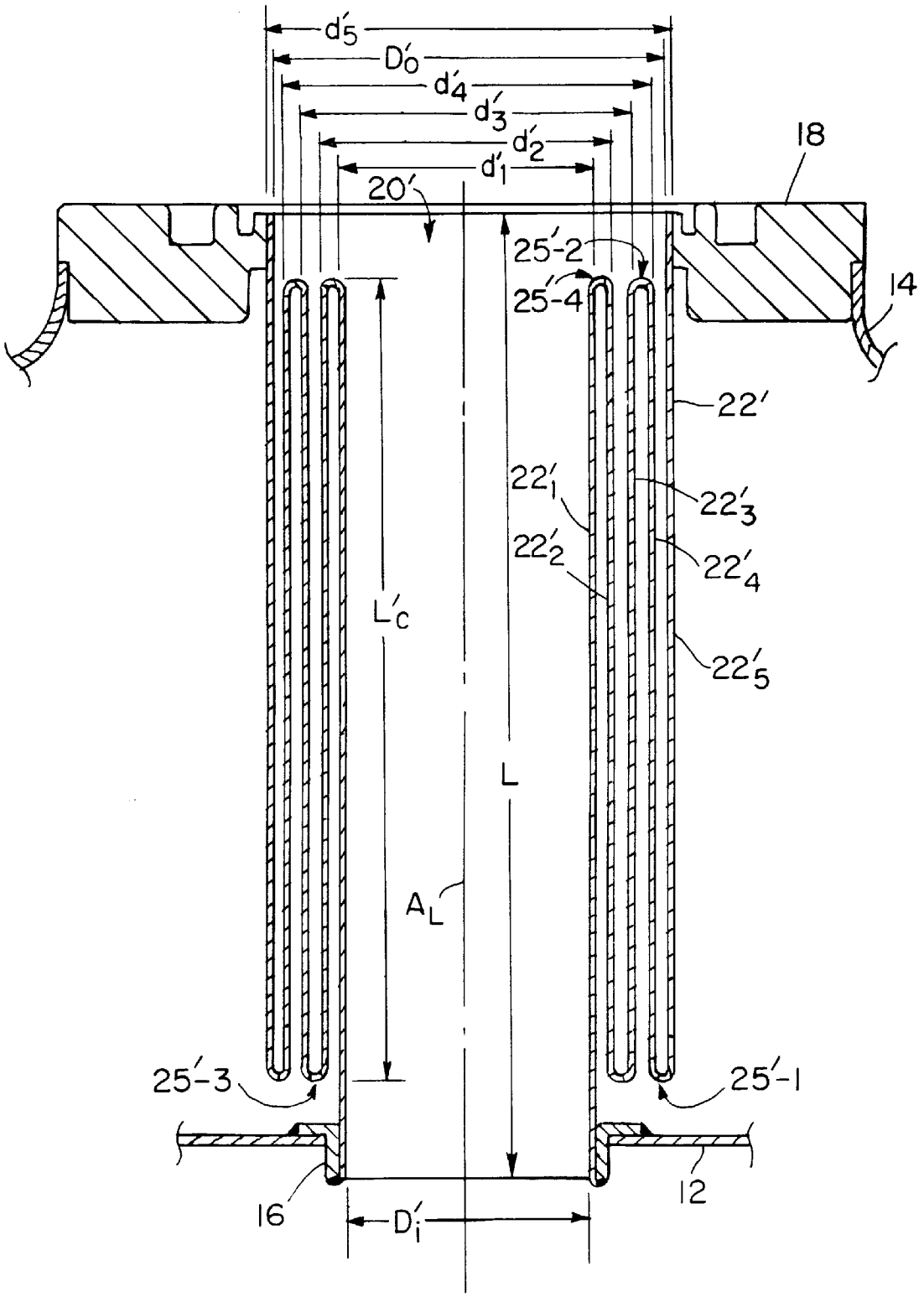
FIG. 3 is a cross-sectional diagram of another preferred neck tube taken along the longitudinal axis.

FIG. 3 is a cross-sectional diagram of another preferred neck tube taken along the longitudinal axis $A_L$. As illustrated, the neck tube 20' has four folds 25'-1, 25'-2, 25'-3, 25'-4. If the convolute lengths $L_c'$ approaches the neck tube length L, the thermal path along the tubing 22' can be increased by a factor of about five. To accommodate the increased number of folds 25', the external port diameter $D_e'$ of the neck tube 20' is increased relative to the embodiment of FIG. 2.

As illustrated, the neck tube 20' includes five concentric tubes $\mathbf{22}_1'$, $\mathbf{22}_2'$, $\mathbf{22}_3'$, $\mathbf{22}_4'$, $\mathbf{22}_5'$, each having a respective outer diameter $d_1'$, $d_2'$, $d_3'$, $d_4'$, $d_5'$. In a particular embodiment, the tube dimensions are as follows:

| Tube | Diameter (inch) | Thickness (inch) |
|---|---|---|
| $22_1'$ | $d_1' = 1.50$ | .020 |
| $22_2'$ | $d_2' = 1.625$ | .020 |
| $22_3'$ | $d_3' = 1.75$ | .018 |
| $22_4'$ | $d_4' = 1.875$ | .020 |
| $22_5'$ | $d_5' = 2.00$ | .020 |

Figure 4:
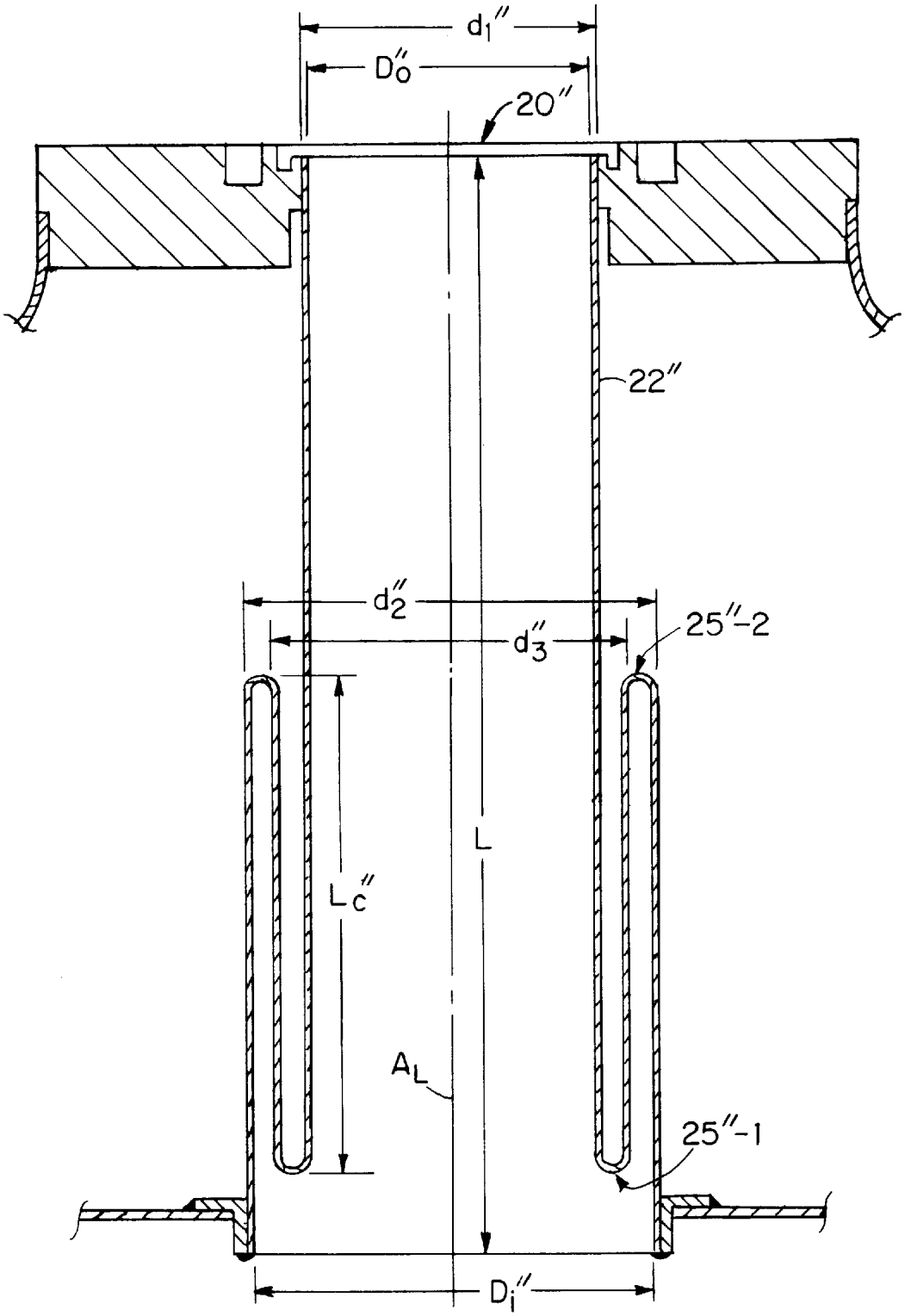
FIG. 4 is a partial cross-sectional diagram of yet another preferred neck tube taken along the longitudinal axis.

FIG. 4 is a cross-sectional diagram of yet another preferred neck tube taken along the longitudinal axis $A_L$. As illustrated, the neck tube 20" includes a first fold 25"-1 and a second fold 25"-2 having a convolute length $L_c''$. Here, the convolute length $L_c''$ is about one-half the neck tube length L. Preferably, $L_c''$ is approximately equal to 0.6L. As such, the effective thermal path along the tubing 22" is effectively doubled relative to a straight tube. Also note that the internal port diameter $D_i''$ is greater than the external port diameter $D_e''$.

As illustrated, the neck tube 20" includes three concentric tubes $\mathbf{22}_1''$, $\mathbf{22}_2''$, $\mathbf{22}_3''$, each having a respective outer diameter $d_1''$, $d_2''$, $d_3''$. These concentric tubes $\mathbf{22}_1''$, $\mathbf{22}_2''$, $\mathbf{22}_3''$ preferably have the same diameter and thickness as the concentric tubes $\mathbf{22}_1$, $\mathbf{22}_2$, $\mathbf{22}_3$ of FIG. 2.

In all of the above embodiments, the neck tube 20 includes a plurality of straight sections of tubing 22 (i.e., convolutes) along the longitudinal axis $A_L$ of the neck tube 20. As such, the neck tube 20 is substantially rigid in the longitudinal direction so as to resist compression and expansion of the distance between the inner vessel 12 and the outer vessel 14. No additional longitudinal supports are required. Although the neck tube 20 is rigid in the longitudinal direction, it is flexible in the lateral direction. The various convolutes and folds 25 in the tubing 22 act as leaf springs to allow lateral flex of the neck tube 20 without permanent deformation or harmful fatigue. As such, the neck tube 20 can securely connect the inner vessel 12 and outer vessel 14 while being resistant to shocks and vibrations. It will also be understood that the number of convolutes and folds in any of the above embodiments can be varied to meet particular requirements.

In accordance with a preferred embodiment of the invention, the convoluted neck tube 20 is fabricated from a single length of a unitary tubing 22. For example, the neck tube 20 can be drawn, swaged, stamped, cast, molded or otherwise fabricated from a suitable material, such as stainless steel. In accordance with another preferred embodiment of the invention, however, the folds are created by welding sections of tubing having differing diameters.

Figure 5A:
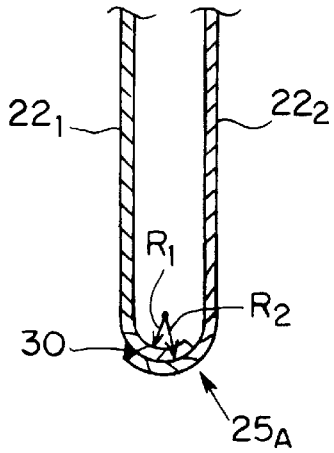
FIGS. 5A–5D are cross-sectional schematic diagrams illustrating preferred welding techniques in accordance with preferred embodiments of the invention.
Figure 5B:
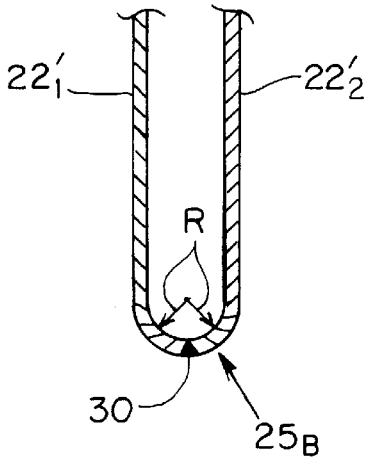
Figure 5C:
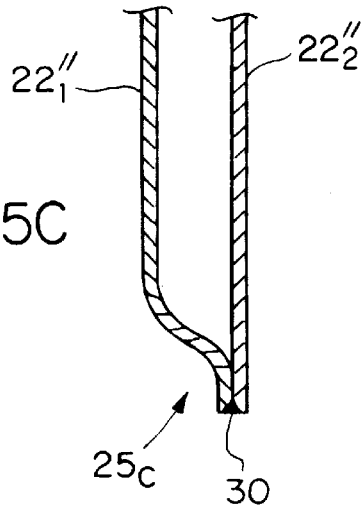

FIGS. 5A–5C are cross-sectional schematic diagrams illustrating preferred welding techniques in accordance with the invention. In each case, two sections of tubing 22 are joined by a weld to create a fold 25.

FIG. 5A is a cross-sectional schematic diagram of an overlapping radii fold. As illustrated, a terminal curve of a first tube section $\mathbf{22}_1$, having a first radius $R_1$ is overlapped by a terminal curve of a second tube section $\mathbf{22}_2$ having a second radius $R_2$ at a fold region $\mathbf{25}_A$. As illustrated, the second radius $R_2$ is larger the first radius $R_1$. A fusion weld 30 is preferably applied at the end of the overlapping tube section $\mathbf{22}_2$ to bond the tube together.

FIG. 5B is a cross-sectional schematic drawing of a butt-radii fold. As illustrated, a first tube section $\mathbf{22}_1'$ and second tube section $\mathbf{22}_2'$ having a respective terminal curve of radius R are arranged to abut at the fold region $\mathbf{25}_B$. The butt ends are welded by a fusion weld 30.

FIG. 5C is a cross-sectional schematic diagram of a one-side swage fold. As illustrated, one tube section $\mathbf{22}_1''$ is swaged and abuts a straight tube section $\mathbf{22}_2''$. A fusion weld 30 is applied at the interface between the tube sections to create a fold $\mathbf{25}_C$. It will be understood that either or both tube sections $\mathbf{22}_1''$, $\mathbf{22}_2''$ can be swaged.

Figure 5D:
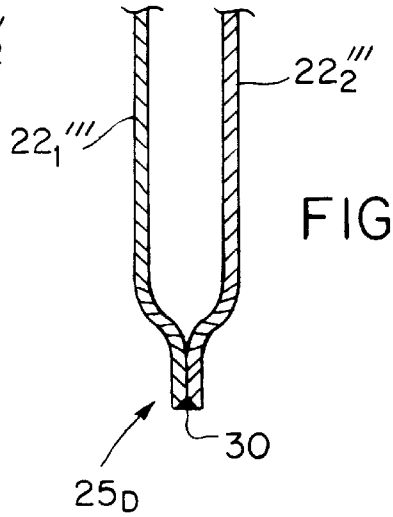

FIG. 5D is a cross-sectional schematic diagram of a two-side swage fold. As illustrated, both tube sections $\mathbf{22}_1'''$, $\mathbf{22}_2'''$ are swaged and abut at a fold point $\mathbf{25}_D'$ where a fusion weld is applied.

The annular separation between concentric tubes can be adapted to suit particular applications. The tube diameter, wall thicknesses and lengths can be chosen to obtain necessary strength and heat transference characteristics. In addition, the lengths of particular convolutes can be chosen to accommodate protrusions into the neck zone, or other reasons. For example, a neck tube can include multiple convolutes of varying lengths to optimize longitudinal rigidity and transverse flexibility for a particular application.

Equivalents

While the invention has been particular shown and described with reference to preferred embodiments thereof, it will be understood to those skilled in the art that various changes in form and detail can be made without departing from the spirit and scope of the invention as defined by the appended claims. For example, although the invention has been described with reference to cryogenic vessels, it will be understood that aspects of the invention can be embodied in other vacuum-jacketed vessels or transfer devices, storing or transferring either hot or cold items.

These and all other equivalents are intended to be encompassed by the following claims.

The invention claimed is:

1. A thermal-insulated vessel comprising:

an inner vessel for storing a material at a first temperature, the inner vessel having a top with an opening;

an outer vessel disposed around the inner vessel and exposed to an ambient environment at a second temperature, the outer vessel having a top with an opening; and a convoluted conduit having a net length bounded by a first end and a second end through which material can pass the convoluted conduit coupling the inner vessel to the outer vessel with the first end terminating at the opening in the top of the inner vessel and the second end terminating at the opening in the top of the outer vessel, the convoluted conduit providing a conductive path between the inner vessel and the outer vessel longer than the net length of the convoluted conduit.

2. The vessel of claim 1 wherein the convoluted conduit comprises a plurality of concentric tube sections.

3. The vessel of claim 1 wherein the convoluted conduit comprises a wall length which is longer than the net length of the convoluted conduit.

4. The vessel of claim 1 wherein the convoluted conduit is flexible along a transverse axis of the convoluted conduit.

5. The vessel of claim 1 wherein the convoluted conduit is substantially rigid along a longitudinal axis of the convoluted conduit.

6. The vessel of claim 1 wherein the convoluted conduit is a unitary piece of material.

7. The vessel of claim 1 wherein the convoluted conduit comprises a plurality of welded folds.

8. The vessel of claim 1 wherein the first temperature is significantly lower than the second temperature.

9. The vessel of claim 8 wherein the first temperature is a cryogenic temperature.

10. The vessel of claim 1 wherein the material is a liquified gas.

11. A thermal-insulated vessel comprising:

an inner vessel for storing a liquified gas at a cryogenic temperature, the inner vessel having a top with an opening;

an outer vessel disposed around the inner vessel and exposed to an ambient environment, the outer vessel having a top with an opening; and a convoluted conduit having a net length bounded by a first end and a second end through which gas can pass, the convoluted conduit coupling the inner vessel to the outer vessel with the first end terminating at the opening in the top of the inner vessel and the second end terminating at the opening in the top of the inner vessel, and comprising a plurality of concentric tube sections joined at annular folds between the top of the inner vessel and the top of the outer vessel to yield a conductive path between the inner vessel and the outer vessel longer than the net length of the convoluted conduit.

12. The vessel of claim 11 wherein the convoluted conduit is flexible along a transverse axis of the convoluted conduit.

13. The vessel of claim 11 wherein the convoluted conduit is substantially rigid along a longitudinal axis of the convoluted conduit.

14. The vessel of claim 11 wherein the convoluted conduit is a unitary piece of material.

15. The vessel of claim 11 wherein the folds include welds.

16. A method of fabricating a thermal-insulated vessel, comprising the steps of:

fabricating an inner vessel having a top with an opening for storing a material at a first temperature;

fabricating an outer vessel having a top with an opening around the inner vessel so as to separate the inner vessel from an ambient environment at a second temperature;

fabricating a convoluted conduit having a net length bounded by a first end and a second end through which material can pass, the convoluted conduit providing a conductive path between the inner vessel and the outer vessel which is longer than the net length of the convoluted conduit; and coupling the inner vessel to the outer vessel with the convoluted conduit with the first end terminating at the opening in the top of the inner vessel and the second end terminating at the opening in the top of the outer vessel.

17. The method of claim 16 wherein the step of fabricating a convoluted conduit comprises arranging a plurality of concentric tube sections.

18. The method of claim 16 wherein the step of fabricating a convoluted conduit comprises forming a wall with a wall length longer than the net length of the convoluted conduit.

19. The method of claim 16 wherein the convoluted conduit is flexible along a transverse axis of the convoluted conduit.

20. The method of claim 16 wherein the convoluted conduit is substantially rigid along a longitudinal axis of the convoluted conduit.

21. The method of claim 16 wherein the step of fabricating a convoluted conduit comprises shaping a unitary piece of material.

22. The method of claim 16 wherein the step of fabricating convoluted conduit comprises forming a plurality of welded folds.

23. The method of claim 16 wherein the first temperature is lower than the second temperature.

24. The method of claim 23 wherein the first temperature is a cryogenic temperature.

25. The method of claim 16 wherein the material is a liquified gas.

26. A method of fabricating a thermal-insulated vessel, comprising the steps of:

fabricating a inner vessel having a top with an opening for storing a liquified gas at a cryogenic temperature;

fabricating an outer vessel having a top with an opening around the inner vessel for exposure to an ambient environment;

fabricating a convoluted conduit through which material can pass, the convoluted conduit having a net length bounded by a first end and a second end, and a plurality of concentric tube sections joined at annular folds to yield a conductive path between the inner vessel and the outer vessel longer than the net length of the convoluted conduit; and coupling the inner vessel to the outer vessel with the convoluted conduit with the first end terminating at the opening in the top of the inner vessel and the second end terminating at the opening in the top of the outer vessel, the annular folds disposed between the top of the inner vessel and the top of the outer vessel.

27. The method of claim 26 wherein the convoluted conduit is flexible along a transverse axis of the convoluted conduit.

28. The method of claim 26 wherein the convoluted conduit is substantially rigid along a longitudinal axis of the convoluted conduit.

29. The method of claim 26 wherein the step of fabricating a convoluted neck comprises shaping a unitary piece of material.

30. The method of claim 26 wherein the folds include welds.

* * * * *